US009608316B2

(12) United States Patent
Choi et al.

(10) Patent No.: US 9,608,316 B2
(45) Date of Patent: Mar. 28, 2017

(54) DUAL BAND PCB ANTENNA FOR VEHICLE

(71) Applicants: Hyundai Motor Company, Seoul (KR); Winnercom Co., Ltd., Gimhae, Gyeongsangnam-do (KR)

(72) Inventors: Youn Jin Choi, Gyeonggi-do (KR); Tae Byung Park, Gyeonggi-do (KR); Ki Jo Kang, Gyeonggi-do (KR)

(73) Assignees: Hyundai Motor Company, Seoul (KR); Winnercom Co., Ltd., Gimhae, Gyeongsangam-do (KR)

( * ) Notice: Subject to any disclaimer, the term of this patent is extended or adjusted under 35 U.S.C. 154(b) by 105 days.

(21) Appl. No.: 14/566,797

(22) Filed: Dec. 11, 2014

(65) Prior Publication Data

US 2015/0236404 A1 Aug. 20, 2015

(30) Foreign Application Priority Data

Feb. 20, 2014 (KR) ..... 10-2014-0019476

(51) Int. Cl.
*H01Q 1/32* (2006.01)
*H01Q 5/10* (2015.01)
*H01Q 5/378* (2015.01)

(52) U.S. Cl.
CPC ..... *H01Q 1/3275* (2013.01); *H01Q 5/10* (2015.01); *H01Q 5/378* (2015.01)

(58) Field of Classification Search
CPC ..... H01Q 1/3275
USPC ..... 343/711–713
See application file for complete search history.

(56) References Cited

U.S. PATENT DOCUMENTS 7,764,236 B2 * 7/2010 Hill ..... H01Q 1/243 343/702
2012/0223862 A1 * 9/2012 Kerselaers ..... H01Q 1/3275 343/700 MS
2012/0326934 A1 * 12/2012 Wakui ..... H01Q 1/3275 343/711
2013/0229315 A1 * 9/2013 Duzdar ..... H01Q 1/3275 343/713
2013/0342405 A1 * 12/2013 Ueno ..... H01Q 1/3275 343/713

FOREIGN PATENT DOCUMENTS

JP 2004-015096 1/2004
KR 10-2001-0098596 A 11/2001
(Continued)

*Primary Examiner* — Dameon E Levi
*Assistant Examiner* — Hasan Islam
(74) *Attorney, Agent, or Firm* — Mintz Levin Cohn Ferris Glovsky and Popeo, P.C.; Peter F. Corless

(57) ABSTRACT

A printed circuit board (PCB) is disposed to stand vertically on a main board and having a first surface and a second surface opposite to the first surface. A main antenna pattern is formed on the first surface of the PCB to operate in dual band including a low frequency band and a high frequency band. A bandwidth extension pattern is formed on the second surface of the PCB and formed to operate in the high frequency band, the bandwidth extension pattern having a coupling stub which forms an overlapping portion with a portion of the main antenna pattern, with the PCB interposed therebetween, to implement an antenna having an extended bandwidth, which operates together with the portion of the main antenna pattern in the high frequency band.

6 Claims, 9 Drawing Sheets

(56) References Cited

FOREIGN PATENT DOCUMENTS

| | | | |
|---|---|---|---|
| KR | 1020060040312 | | 5/2006 |
| KR | 1020060104592 | | 10/2006 |
| KR | 10-2011-0049564 | A | 5/2011 |
| KR | 10-2013-0063139 | A | 6/2013 |
| KR | 1020130063139 | | 6/2013 |

* cited by examiner

| m1 | m2 |
|---|---|
| freq=2.000GHz | freq=1.750GHz |
| S(1,1)=0.470/83.422 | S(1,1)=0.650/-62.689 |
| impedance=Z0*(0.700-j1.398) | impedance=Z0*(0.700-j1.398) |

| m1 | m2 |
|---|---|
| freq=1.750GHz | freq=2.000GHz |
| S(2,2)=0.535/113.706 | S(1,1)=0.507/-111.093 |
| impedance=Z0*(0.416-j0.571) | impedance=Z0*(0.458-j0.583) |

DUAL BAND PCB ANTENNA FOR VEHICLE

CROSS-REFERENCE TO RELATED APPLICATION

This application claims under 35 U.S.C. §119(a) the benefit of Korean Patent Application No. 10-2014-0019476 filed on Feb. 20, 2014, the entire contents of which are incorporated herein by reference.

BACKGROUND (a) Technical Field

The present disclosure relates to an antenna for a vehicle. More particularly, the present disclosure relates to a dual band printed circuit board (PCB) antenna having an extended bandwidth for a vehicle, which is disposed on a main board having a feed circuit thereon and can stably operate in both low and high frequency bands.

(b) Background Art

An antenna for a vehicle performs a function of transmitting/receiving radio signals so that a transceiver for broadcast/communication, mounted inside the vehicle, can communicate with an external device. An antenna of the related art for a vehicle is typically mounted only for the purpose of receiving AM/FM radio signals. A passive antenna of a monopole type, which does not include an amplifying circuit therein, has been widely used as such an antenna. However, the antenna of the related art requires a physical length of about 70 cm and hence becomes a factor that deteriorates the appearance and the driving performance of the vehicle.

Accordingly, an active antenna including an internal amplifying circuit has been developed in order to reduce the physical length of the antenna and to overcome the deterioration of reception signals. The active antenna mainly has the form of a poly-type helical antenna, which is an antenna having a structure of a spiral coil shape so that resonance can be generated with a length shorter than the basic resonance length. The helical antenna can receive broadcast signals by generating resonance at a specific frequency through adjustment of its length, pitch, etc.

Meanwhile, as services including mobile communications and the like are commercialized, various equipment and new electronic products, to which information/communication technologies are applied, have been continuously developed. In addition, electronic products for performing functions related to Internet, TV, GPS, satellite radio, DMB, telematics and the like have been developed and mounted in vehicles in order to satisfy various customers' requirements. As the variety of radio services in a vehicle, including Internet, TV, GPS, satellite radio, DMB, telematics and the like, increase as described above, the need for an antenna capable of operating in various frequency bands, and particularly an integrated antenna for supporting radio communication services in several bands, also increases.

Hereinafter, an integrated antenna for a vehicle according to the related art will be described with reference to the accompanying drawing.

FIG. 1 is a perspective view showing an example of an integrated antenna for a vehicle, which is implemented with a shark-fin antenna, in which its case is indicated with a dotted line.

As shown in this figure, the shark-fin antenna includes a pad 1, a frame 2, a case 3, a main board 4 and the like, and may be provided with a patch antenna 5, a helical antenna 6, a PCB antenna 7 and the like, which are built-in antennas connected to the main board 4. Here, the patch antenna 5 may be a satellite radio antenna that operates in a satellite radio frequency band, and the helical antenna 6 may be an antenna for receiving broadcast signals, e.g., a DMB receiving antenna that operates in a DMB frequency band. The PCB antenna 7 is an antenna implemented by forming an antenna pattern designed to operate in a predetermined frequency band on a surface of a PCB and then connecting the antenna pattern to a circuit of the main board 4. In addition, the PCB antenna 7 may be an antenna that operates in a mobile communication frequency band.

A telematics unit (TMU) has integrated antennas built therein to communicate with external devices, thereby having a function of transmitting/receiving radio signals for the TMU. Recently, integrated antennas have evolved into specifications of long term evolution (LTE) from specifications of the existing TMU. The LTE has a broad frequency bandwidth while having a multi-band, and thus, it is necessary to develop an LTE antenna for extending the bandwidth of operating frequencies. More specifically, the use frequency of the LTE is changed for each communication provider. For example, the use frequency of the LTE has a multi band such as 824 MHz to 894 MHz, 1710 MHz to 1870 MHz and 1920 MHz to 2170 MHz.

Accordingly, in order to implement an antenna satisfying operating characteristics of the multi band, it is required to develop a dual band antenna, particularly an antenna having a broad bandwidth in the high frequency band, that operates, for example, in a low frequency band of 824 MHz to 894 MHz and a high frequency band of 1710 MHz to 2170 MHz.

However, in order to implement the LTE antenna with the multi-band operating characteristics, bandwidth should be extended so that the LTE antenna can operate in a broader frequency band, including the existing mobile communication frequency bands. However, it can be difficult to apply a general bandwidth extension method to the dual band antenna. For example, when a method for extending a bandwidth in a high frequency band is applied in order to implement a dual band antenna that operates in both the low frequency band of 824 MHz to 894 MHz and the high frequency band of 1710 MHz to 2170 MHz, the low frequency band can be negatively affected, making it is difficult to use the dual band antenna.

SUMMARY OF THE DISCLOSURE

The present disclosure provides an antenna for a vehicle, which can stably operate in a dual band. The present disclosure also provides a dual band PCB antenna having an extended bandwidth for a vehicle, which is disposed on a main board having a feed circuit thereon. The dual band PCB antenna can be disposed in a shark-fin antenna, can stably operate in both low and high frequency bands without negatively affecting the low frequency band, and can relatively extend the bandwidth of the high frequency band.

In an embodiment, the present disclosure provides a dual band PCB antenna having an extended bandwidth for a vehicle, which is disposed on a main board having a feed circuit formed thereon, the dual band PCB antenna including: a PCB disposed to stand vertically on the main board and having a first surface and a second surface opposite to the first surface; a main antenna pattern formed on the first surface of the PCB to operate in dual band including a low frequency band and a high frequency band; and a bandwidth extension pattern formed on the second surface of the PCB and formed to operate in the high frequency band, the bandwidth extension pattern having a coupling stub which forms an overlapping portion with a portion of the main antenna pattern, with the PCB interposed therebetween, to implement an antenna having an extended bandwidth, which operates together with the portion of the main antenna pattern in the high frequency band.

In an embodiment, the bandwidth extension pattern may be connected to a ground through the main board. The bandwidth extension pattern may be vertically formed on the second surface of the PCB. The coupling stub extends so as to protrude sideward from one side of the bandwidth extension pattern. A ground connection terminal that is a lower end portion of the bandwidth extension pattern may be connected to the ground through the main board. The main antenna pattern may include a lower first pattern portion and an upper second pattern portion formed on the first surface of the PCB; a low frequency band pass filter portion formed between the first and second pattern portions to reject signals of the high frequency band in the low and high frequency bands; and a feed portion formed at the first pattern portion that is electrically connected to the feed circuit of the main board. The low frequency band pass filter portion may be configured to include first and second inductor patterns respectively formed on the first and second surfaces of the PCB to have inductor elements, and a capacitor pattern formed on the second surface of the PCB to have a capacitor element. The capacitor pattern may be integrally connected to the first pattern portion, the first inductor pattern may be integrally connected to the capacitor pattern, and the second inductor pattern may be electrically connected to the first inductor pattern and the second pattern portion. The second inductor pattern may be electrically connected to the first inductor pattern and the first pattern portion through a via hole formed in the PCB. The first and second inductor patterns may be formed as loop-shaped patterns of which both ends are opened on the first and second surfaces of the PCB. The opening directions of both ends of the first and second inductor patterns may be different from each other. The first and second inductor patterns may be electrically connected to each other through the via hole, thereby entirely having a spiral pattern shape.

Accordingly, the PCB antenna of the present disclosure is provided with a main antenna pattern operating in the dual band including a low frequency band and a high frequency band and a separate bandwidth extension pattern coupled to a first pattern portion operating in the high frequency band in the main antenna pattern, so that the bandwidth of the high frequency band is extended without negatively affecting the operating performance of the low frequency band, thereby stably operating in the dual band.

The above and other features of the disclosure are discussed infra.

BRIEF DESCRIPTION OF THE DRAWINGS

The above and other features of the present disclosure will now be described in detail with reference to certain embodiments thereof illustrated the accompanying drawings which are given hereinbelow by way of illustration only, and thus are not limitative of the present disclosure, and wherein.

Figure 1:
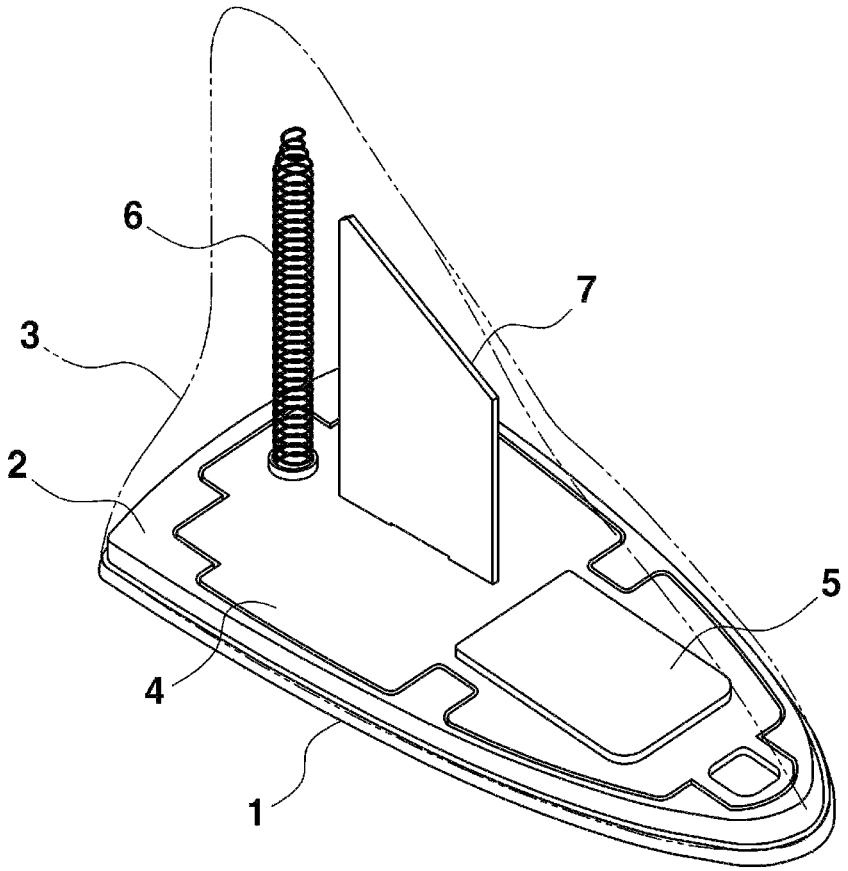
FIG. 1 RELATED ART
FIG. 1 is a perspective view showing an example of an integrated antenna for a vehicle, which is implemented with a shark-fin antenna.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in part by the particular intended application and use environment. In the figures, reference numbers refer to the same or equivalent parts of the present disclosure throughout the several figures of the drawing.

DETAILED DESCRIPTION

Hereinafter reference will now be made in detail to various embodiments of the present disclosure, examples of which are illustrated in the accompanying drawings and described below. While the disclosure will be described in conjunction with embodiments, it will be understood that present description is not intended to limit the disclosure to those embodiments. On the contrary, the disclosure is intended to cover not only the embodiments, but also various alternatives, modifications, equivalents and other embodiments, which may be included within the spirit and scope of the disclosure as defined by the appended claims.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The present disclosure provides a dual band PCB antenna having an extended bandwidth for a vehicle, which is disposed on a main board having a feed circuit thereon in a shark-fin antenna and can stably operate in both low and high frequency bands. Particularly, the present disclosure provides a PCB antenna which stably operates in a dual band without negatively influencing a low frequency band and relatively extends the bandwidth of a high frequency band in the dual band. The PCB antenna according to the disclosed embodiments can operate in a double band of long term evolution (LTE) through a method of dividing a multi-band frequency range of the LTE into the double band, e.g., a low frequency band of 824 MHz to 894 MHz, for example, and a high frequency band of 1710 MHz to 2170 MHz, for example, and extending the bandwidth of the high frequency band. To this end, the PCB antenna can include an additional monopole antenna pattern, i.e., a separate bandwidth extension pattern formed on a surface of a PCB mounted on a main board.

Figure 2:
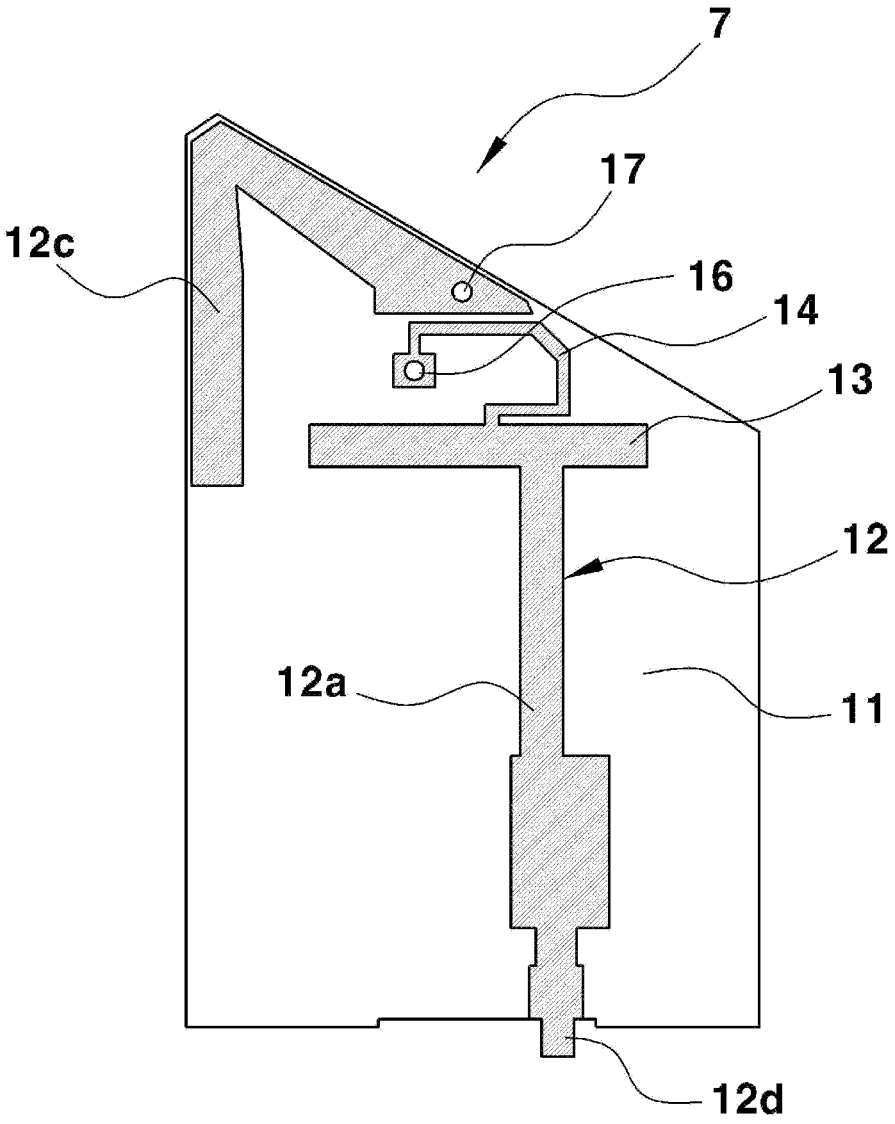
FIG. 2 is a front view of a PCB antenna according to an embodiment of the present disclosure.
Figure 3:
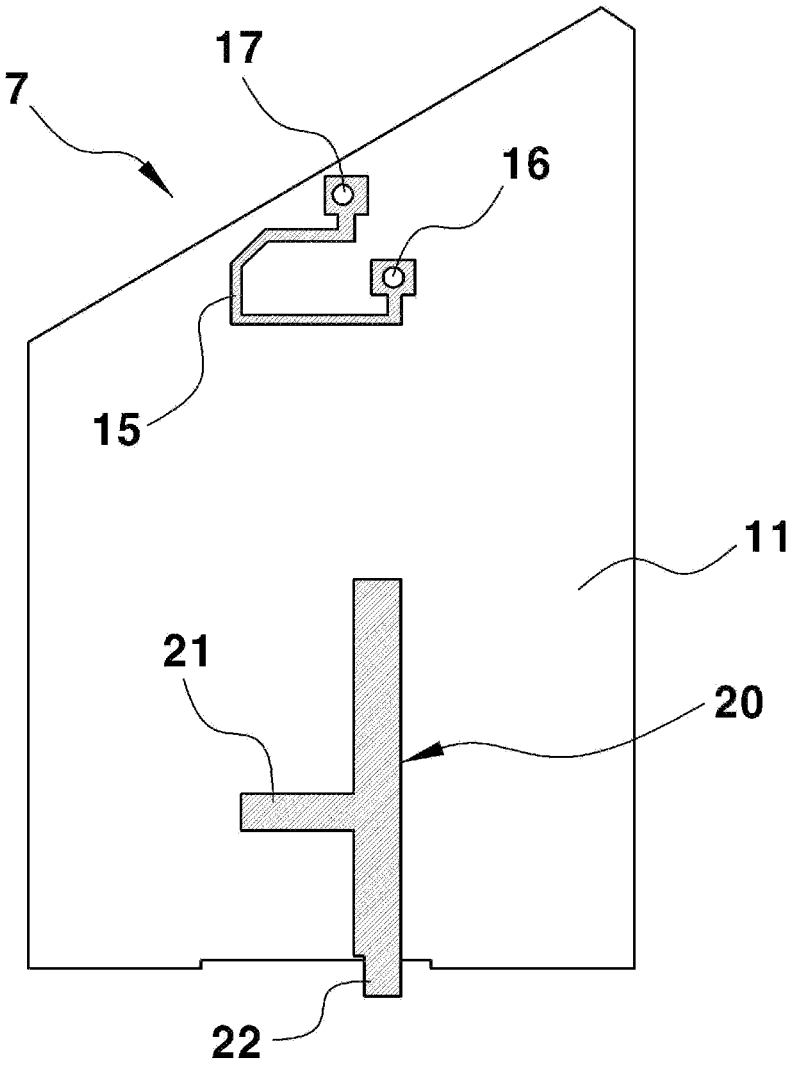
FIG. 3 is a rear view of the PCB antenna according to the embodiment of the present disclosure.

This will be described in detail with reference to the accompanying drawings. FIG. 2 is a front view of a PCB antenna according to an embodiment of the present disclosure. FIG. 3 is a rear view of the PCB antenna according to the embodiment of the present disclosure.

Figure 4:
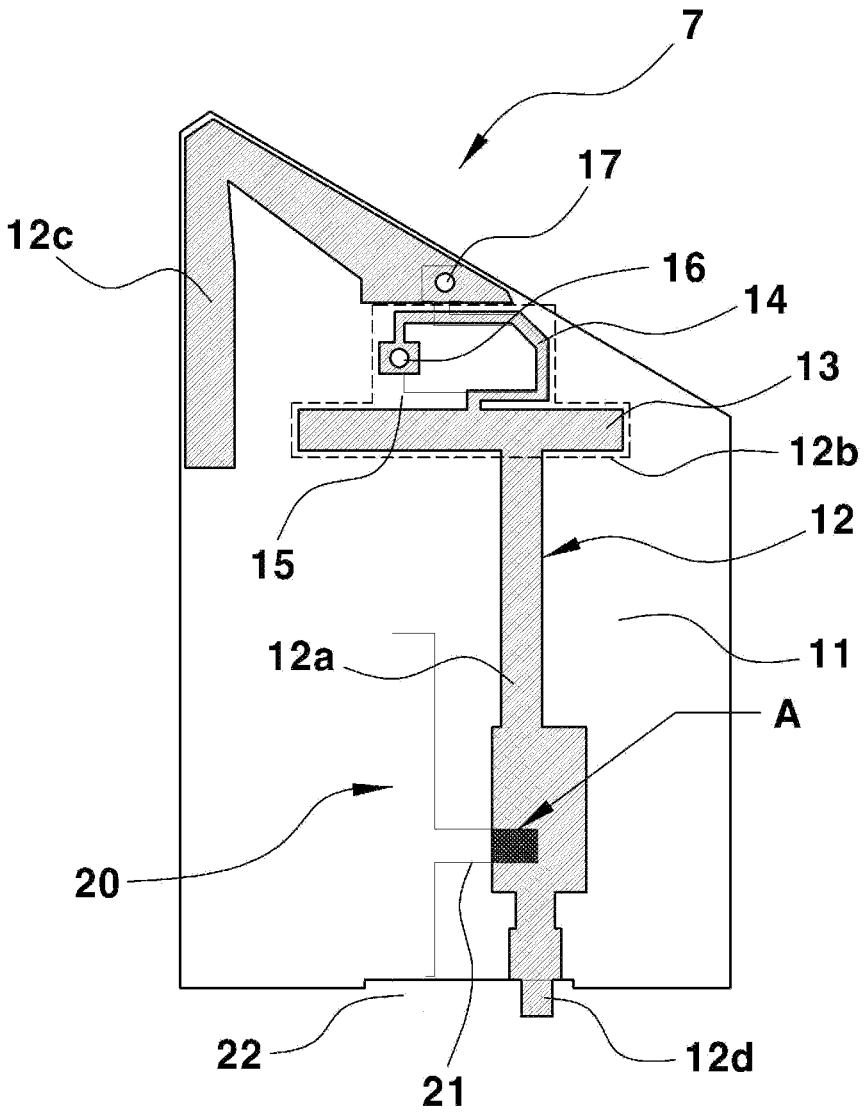
FIG. 4 is a front perspective view of the PCB antenna according to the embodiment of the present disclosure.
Figure 5:
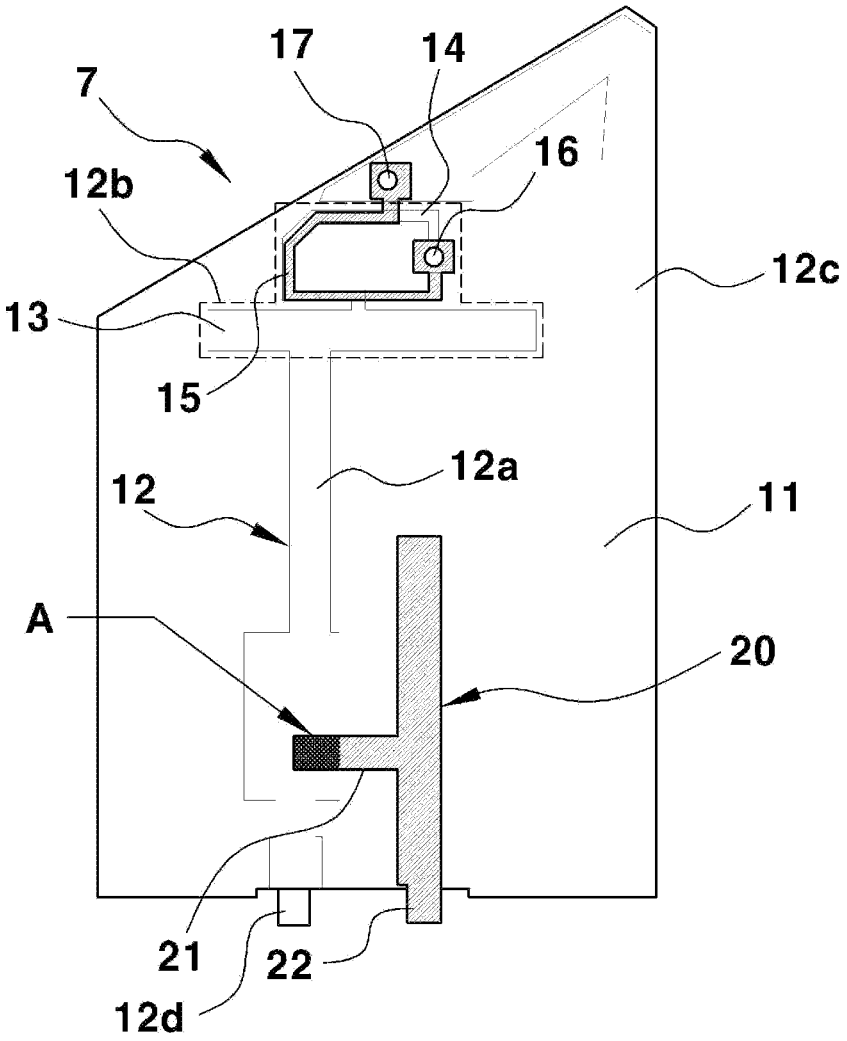
FIG. 5 is a rear perspective view of the PCB antenna according to the embodiment of the present disclosure.

FIGS. 4 and 5 are respectively front and rear perspective views of the PCB antenna according to the embodiment of the present disclosure. In the front perspective view of FIG. 4, a second inductor pattern 15 and a bandwidth extension pattern 20, formed on a rear surface of a PCB 11, are indicated with solid lines. In the rear perspective view of FIG. 5, a first pattern portion 12*a*, a capacitor pattern 13, a first inductor pattern 14 and a second pattern portion 12*c*, formed on a front surface of the PCB 11, are indicated with solid lines.

The dual band PCB antenna 7 of the embodiment shown in FIGS. 2 to 5 may be disposed to stand vertically on a main board (reference numeral 4 of FIG. 1) having a feed circuit thereon in a shark-fin antenna as illustrated in FIG. 1. The dual band PCB antenna 7 of the embodiment includes the PCB 11, a main antenna pattern 12 and the bandwidth extension pattern 20. The main antenna pattern 12 is formed of a conductor on a surface of the PCB 11, and has a feed portion 12*d* and a low frequency band pass filter portion 12*b*. The bandwidth extension pattern 20 formed of a conductor on a surface of the PCB 11, and has a coupling stub 21 that is a pattern portion coupled to the main antenna pattern 12.

More specifically, the main antenna pattern 12 operating in the dual band of the LTE is formed on the surface of the PCB 11. The main antenna pattern 12 is electrically connected to the feed circuit on the main board (reference numeral 4 of FIG. 1) through the feed portion 12*d*.

In the main antenna pattern 12, the entire configuration is used in the low frequency band, and the second pattern portion 12*c* described later is used as a dual band monopole antenna that operates in the high frequency band.

The main antenna pattern 12, as shown in FIGS. 2 to 5, includes the lower first pattern portion 12*a* and the upper second pattern portion 12*c*, formed on one surface (front surface) of the PCB 11, the low frequency band pass filter portion 12*b* having strip lines respectively formed on both the surfaces (front and rear surfaces) of PCB 11 to be combined with each other, and the feed portion 12*d* formed at a lower end of the first pattern portion 12*a*.

Here, the first pattern portion 12*a* is a portion that is formed of a conductor pattern with a predetermined length (predetermined height) vertically formed long at a lower side of the PCB 11, and the second pattern portion 12*c* is a portion that is formed of a conductor pattern with a predetermined length at an upper side of the PCB 11.

The feed portion 12*d* is a portion that electrically connects the main antenna pattern 12 to the feed circuit of the main board. The feed portion 12*d* is also formed of a conductor on the one surface of the PCB 11.

The low frequency band pass filter portion 12*b* is provided between the first and second pattern portions 12*a* and 12*c*. The lower frequency band pass filter portion 12*b* is configured to include two conductor patterns respectively formed on the front and rear surfaces of the PCB 11, i.e., two strip lines formed to have a relatively thin width.

More specifically, the low frequency band pass filter portion 12*b* is configured with the first and second inductor patterns 14 and 15 respectively formed on both the surfaces (front and rear surfaces) of the PCB 11 to have inductor elements, and the capacitor pattern 13 formed on the one surface (front surface) of the PCB 11 to have a capacitor element.

Here, the capacitor pattern 13 is a pattern portion formed to be integrally connected to an upper end portion of the first pattern portion 12*a*, and the first inductor pattern 14 is a pattern portion formed to be integrally connected to the capacitor pattern 13. The second inductor pattern 15 electrically connects between the first inductor pattern 14 and the second pattern portion 12*c*.

To this end, a via hole 16 is formed in the PCB 11, and the first and second inductor patterns 14 and 15 respectively formed on both the surfaces of the PCB 11 in the low frequency band pass filter portion 12*b* are electrically connected to each other through the via hole 16.

In addition, the second inductor pattern 15 is electrically connected to one end portion of the second pattern portion 12*c* through another via hole 17 of the PCB 11.

In this state, the first and second inductor patterns 14 and 15 are formed as loop-shaped patterns of which both ends are opened on both the surfaces of the PCB 11. Here, the opening directions of both the ends are different from each other. The first and second inductor patterns 14 and 15 are electrically connected to each other through the via hole 16, thereby entirely having a spiral pattern shape.

In the configuration described above, the first inductor pattern 14 is formed to be integrally connected to the capacitor pattern 13, and therefore, the first and second inductor patterns 14 and 15 have a structure connected in series to the capacitor pattern 13.

The low frequency band pass filter portion 12*b* having the first and second inductor patterns 14 and 15 combined with each other as described above performs a function of passing only frequency signals in the low frequency band and rejecting frequency signals in the high frequency band.

Accordingly, the entire main antenna pattern 12 configured to include the first pattern portion 12*a*, the second pattern portion 12*c*, the low frequency band pass filter portion 12*b* and the feed portion 12*d* becomes a monopole antenna that operates in the low frequency band (e.g., 824 MHz to 894 MHz). In addition, the second pattern portion 12*c* and the bandwidth extension pattern 20 described later become another monopole antenna that operates in the high frequency band (e.g., 1710 MHz to 2170 MHz).

Thus, the PCB antenna 7 of the embodiment becomes an antenna that can operate in the dual band including the high frequency band and the low frequency band. Particularly, the separate bandwidth extension pattern 20 is additionally provided, so that the bandwidth of the high frequency band can be extended much broader without having influence on operating characteristics of the low frequency band.

The bandwidth extension pattern 20 is formed on the opposite surface to the second pattern portion 12*c* in the PCB 11. If the second pattern portion 12*c* is formed on the front surface of the PCB 11, the bandwidth extension pattern 20 is formed on the rear surface that is the opposite surface to the front surface.

The bandwidth extension pattern 20 is formed at a predetermined distance from the second pattern portion 12*c* on the opposite surface of the PCB 11. As illustrated in these figures, the bandwidth extension pattern 20 may be vertically formed long on the surface of the PCB 11.

In this state, the bandwidth extension pattern 20 may be vertically formed long in parallel to the second pattern portion 12*c* to be spaced apart from the second pattern portion 12*c* at a predetermined distance in the PCB 11. A lower end portion of the bandwidth extension pattern 20 is used as a ground connection terminal 22.

That is, the lower end portion of the bandwidth extension pattern 20 is not connected to the feed circuit of the main board but connected to a ground through the main board.

The bandwidth extension pattern 20 has the coupling stub 21 for coupling to the main antenna pattern at one side thereof, more specifically, for coupling to the second pattern portion 12*c*. In this case, the coupling stub 21 is a pattern portion extended to protrude sideward from one side of the bandwidth extension pattern 20. Particularly, the coupling stub 21 is formed so that portions of the coupling stub 21 can be overlapped with the second pattern portion 12*c* on the respective front and rear surfaces of the PCB 11.

In FIGS. 4 and 5, hatching portions indicated by 'A' represent overlapping portions of the coupling stub 21, which are overlapped with the second pattern portion 12*c* on the respective front and rear surfaces of the PCB 11.

As a result, the additional bandwidth extension pattern 20 described above is configured with a ground antenna connected to the ground and a monopole antenna operating together with the second pattern portion 12*c* of the main antenna pattern 12 in the high frequency band. Accordingly, the bandwidth of the high frequency band can be extended broad by the bandwidth extension pattern 20.

If only the second pattern portion 12*c* is used as the monopole antenna operating in the high frequency band without the bandwidth extension pattern 20, the entire main antenna pattern 12 acts as an antenna operating in the low frequency band, and the second pattern portion 12*c* acts as an antenna operating in the high frequency band, thereby obtaining a dual band antenna. However, in the configuration described above, it is difficult to guarantee stable operating performance due to influence on operating performance in the low frequency band. In addition, it is difficult to perform tuning for broadly extending the bandwidth of the high frequency band.

However, in the present disclosure, when the bandwidth extension pattern 20 is additionally provided, it is possible to implement a stable dual band antenna without having great influence on the performance of the low frequency band. Further, it is possible to adjust the length of the bandwidth extension pattern 20, the position or size (area overlapped with the second pattern portion) of the coupling stub 21, or the like, thereby performing tuning suitable for operating characteristics.

Figure 6:
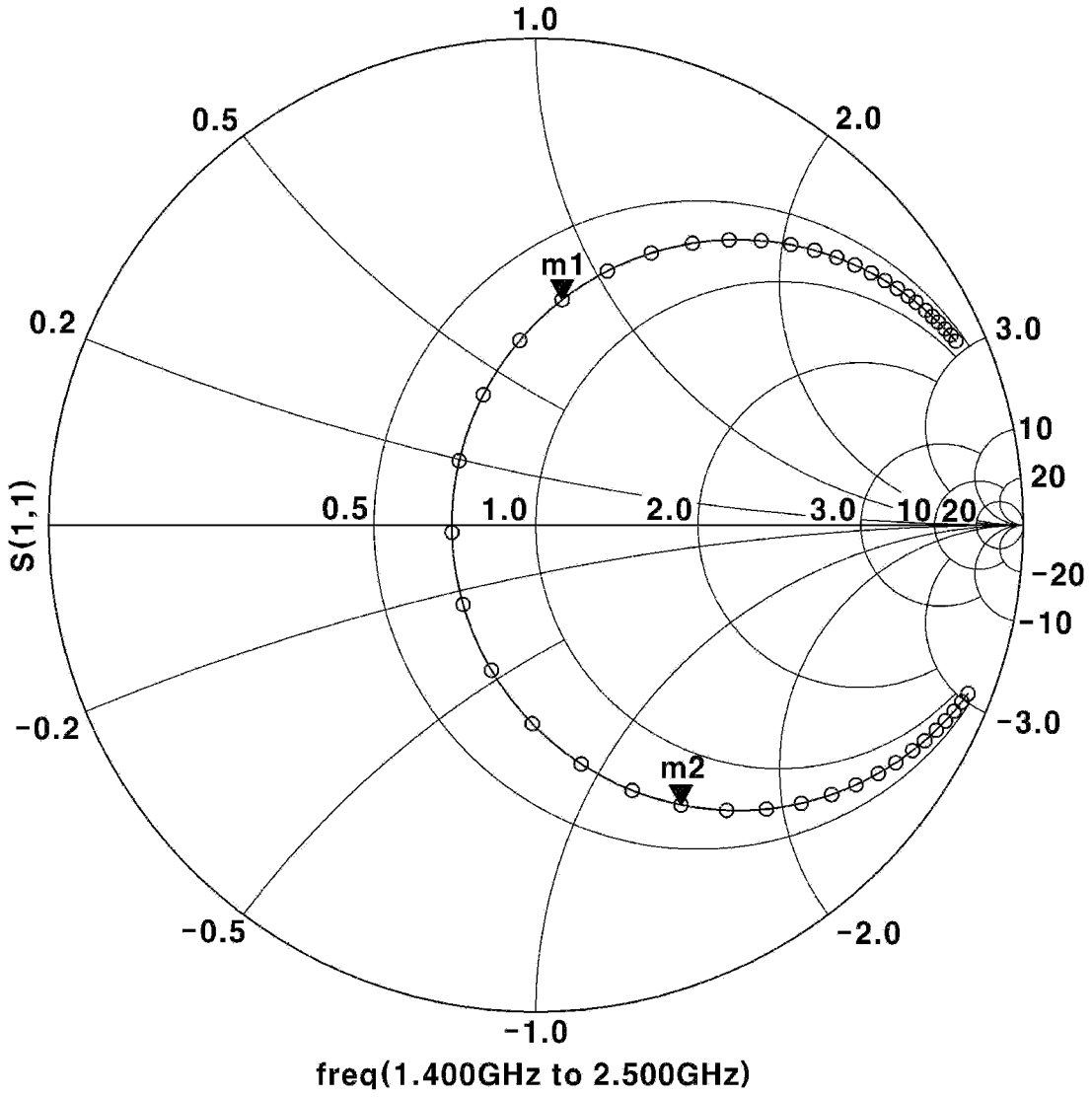
FIGS. 6 and 7 are views showing impedance of a monopole antenna in a high frequency band and impedance of an additional monopole antenna connected to a ground.
Figure 7:
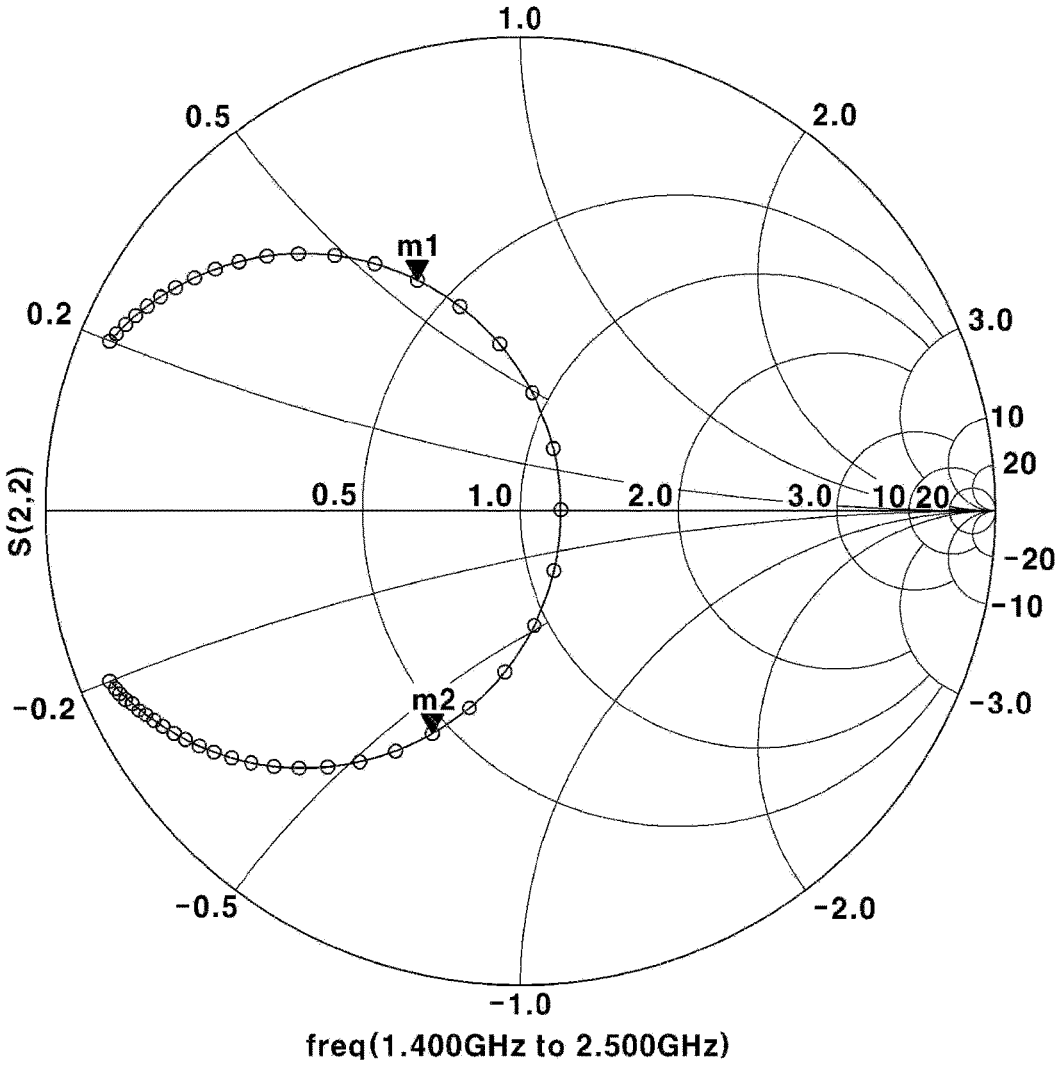

FIGS. 6 and 7 show impedance of the monopole antenna (main antenna pattern) in the high frequency band and impedance of the additional monopole antenna (extension pattern) connected to the ground.

As shown in FIG. 6, impedance characteristics of the monopole antenna in the high frequency band are similar to those of an open type serial resonator.

The impedance at a resonant frequency is near 50Ω, and serial capacitance is added to the impedance at a frequency lower than the resonant frequency. In addition, serial inductance is added to the impedance at a frequency higher than the resonant frequency.

On the other hand, as shown in FIG. 7, impedance characteristics of the additional monopole antenna are opposite to those of the monopole antenna (main antenna pattern) in the high frequency band. The impedance at the resonant frequency is near 50Ω, and an inductance element is added at a frequency lower than the resonant frequency. In addition, a capacitance element is added at a frequency higher than the resonant frequency.

The impedance of the additional monopole antenna is added to that of the existing dual band antenna (main antenna pattern), thereby extending the bandwidth in the high frequency band. In order to extending the bandwidth through the impedance coupling of the two antennas, the impedance variation (impedance variation with respect to a change in frequency) of the high frequency band of the existing dual band antenna is necessarily similar to the impedance variation (impedance variation with respect to a change in frequency) of the additional monopole antenna. Then, the bandwidth of the high frequency band can be extended through the impedance coupling of the two antennas.

In addition, the impedance coupling position, amount and method of the two antennas are important, and a PCB type capacitor is applied in the present disclosure.

That is, the dual band monopole antenna (main antenna pattern, particularly the second pattern portion) is formed on the front surface of the PCB 11, and the coupling stub 21 is positioned on the rear surface of the PCB 11, so that the impedance coupling is made by a capacitance value formed between the two patterns.

Such a method has less influence on the low frequency band of the main antenna pattern 12. Thus, the method is a method suitable for being applied to the dual band PCB antenna of the present disclosure.

In addition, the impedance coupling amount can be adjusted using the size (overlapped area) of the coupling stub 21, and the impedance coupling position can be tuned by adjusting the position of the coupling stub 21.

The position and size of the coupling stub 21 can be determined using an EM simulation tool (e.g., EM-Pro), in consideration of required antenna operating characteristics.

Figure 8:
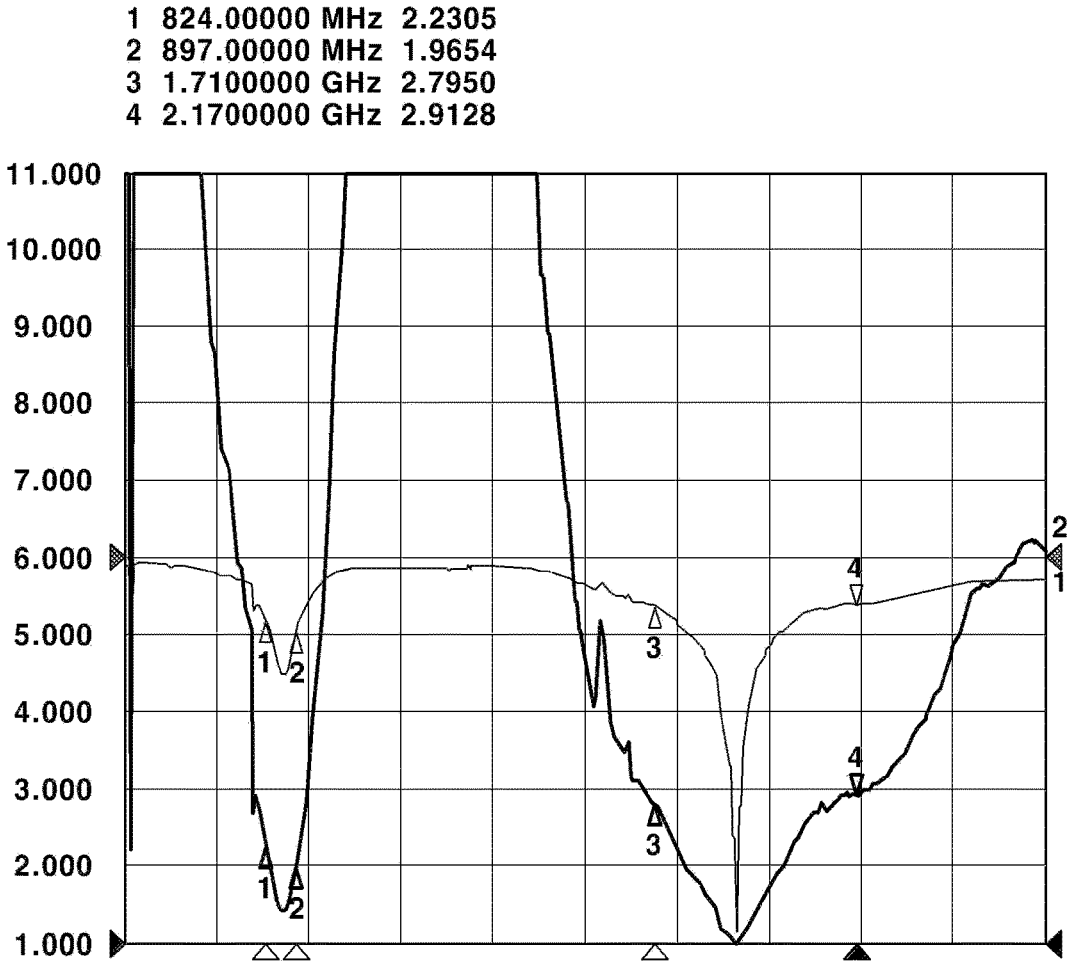
FIG. 8 is a view showing voltage standing wave ratio (VSWR) measurement results of the existing dual band monopole antenna having no bandwidth extension pattern.
Figure 9:
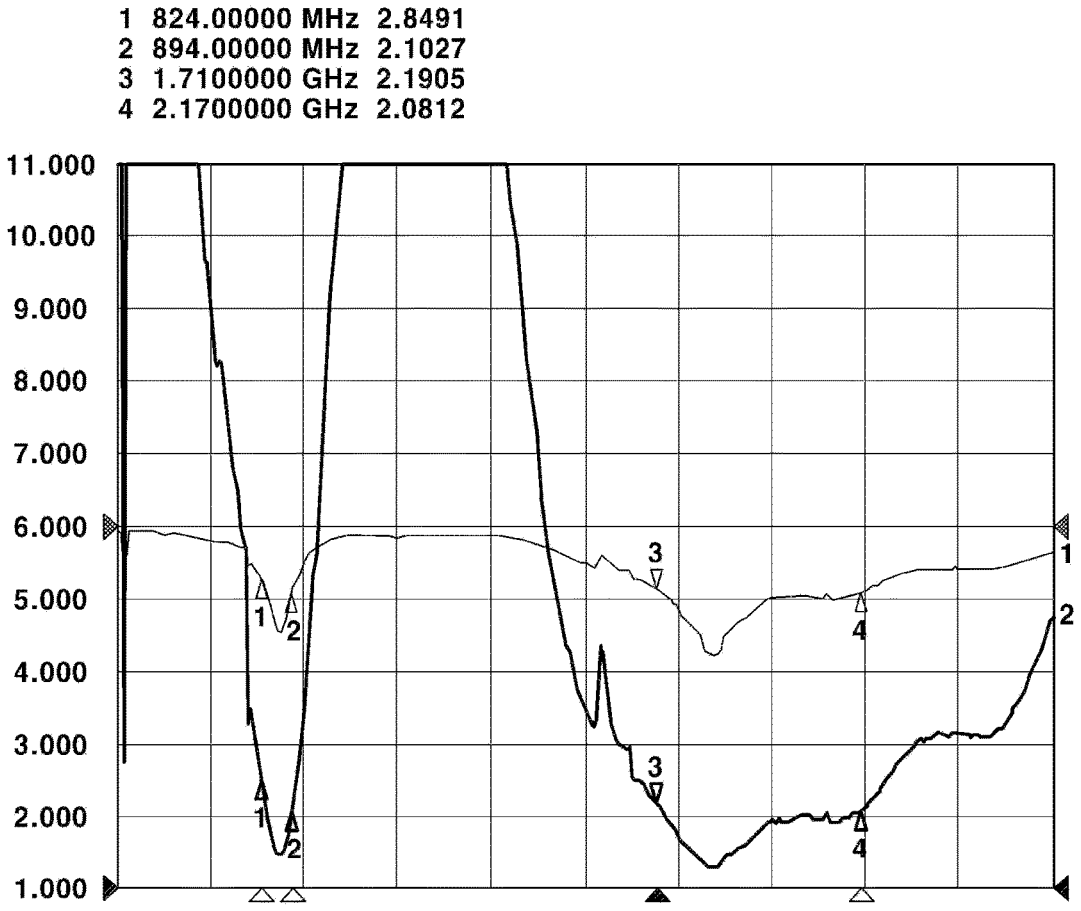
FIG. 9 is a view showing VSWR measurement results of the antenna having a bandwidth extension pattern according to the embodiment of the present disclosure.

FIG. 8 shows voltage standing wave ratio (VSWR) measurement results of the existing dual band monopole antenna having no bandwidth extension pattern (the dual band antenna implemented by forming only the main antenna pattern). FIG. 9 is a view showing VSWR measurement results of the antenna having a bandwidth extension pattern according to the embodiment of the present disclosure.

In the existing dual band monopole antenna, the bandwidth of the high frequency band was 16.4%, based on a VSWR of 2.5. On the other hand, in the antenna having the bandwidth extension pattern 20, the bandwidth of the high frequency band was 28%, which increased.

The disclosure has been described in detail with reference to exemplary embodiments thereof. However, it will be appreciated by those skilled in the art that changes may be made in these embodiments without departing from the principles and spirit of the disclosure, the scope of which is defined in the appended claims and their equivalents.

What is claimed is:

1. A dual band printed circuit board (PCB) antenna having an extended bandwidth for a vehicle, which is disposed on a main board having a feed circuit formed thereon, the dual band PCB antenna comprising:

a PCB disposed to stand vertically on the main board and having a first surface and a second surface opposite to the first surface;

a main antenna pattern formed on the first surface of the PCB to operate in dual band including a low frequency band and a high frequency band; and a bandwidth extension pattern formed on the second surface of the PCB and formed to operate in the high frequency band, the bandwidth extension pattern having a coupling stub which forms an overlapping portion with a portion of the main antenna pattern, with the PCB interposed therebetween, to implement an antenna having an extended bandwidth, which operates together with the portion of the main antenna pattern in the high frequency band, wherein the main antenna pattern includes:

a lower first pattern portion and an upper second pattern portion formed on the first surface of the PCB; and a low frequency band pass filter portion formed between the first and second pattern portions to reject signals of the high frequency band in the low and high frequency bands, wherein the low frequency band pass filter portion is configured to include first and second inductor patterns respectively formed on the first and second surfaces of the PCB to have inductor elements, and a capacitor pattern formed on the second surface of the PCB to have a capacitor element, wherein the capacitor pattern is integrally connected to the first pattern portion, the first inductor pattern is integrally connected to the capacitor pattern, and the second inductor pattern is electrically connected to the first inductor pattern and the second pattern portion, and wherein the second inductor pattern is electrically connected to the first inductor pattern and the first pattern portion through a via hole formed in the PCB.

2. The dual band PCB antenna of claim 1, wherein the bandwidth extension pattern is connected to a ground through the main board.

3. The dual band PCB antenna of claim 1, wherein the bandwidth extension pattern is vertically formed on the second surface of the PCB, and wherein the coupling stub extends so as to protrude sideward from one side of the bandwidth extension pattern.

4. The dual band PCB antenna of claim 1, wherein a ground connection terminal that is a lower end portion of the bandwidth extension pattern is connected to a ground through the main board.

5. The dual band PCB antenna of claim 1, wherein the main antenna pattern further includes:

a feed portion formed at the first pattern portion that is electrically connected to the feed circuit of the main board.

6. The dual band PCB antenna of claim 5, wherein the first and second inductor patterns are formed as loop-shaped patterns of which both ends are opened on the first and second surfaces of the PCB, wherein opening directions of both ends of the first and second inductor patterns are different from each other, and wherein the first and second inductor patterns are electrically connected to each other through the via hole, thereby entirely having a spiral pattern shape.

* * * * *